US005610375A

United States Patent [19]

Sinthomez

[11] Patent Number: 5,610,375

[45] Date of Patent: Mar. 11, 1997

[54] CIRCUIT BREAKER WITH PIVOTING CONTROL BUTTONS

[75] Inventor: Daniel Sinthomez, Pont de Pagny, France

[73] Assignee: Schneider Electric, France

[21] Appl. No.: 356,309

[22] PCT Filed: Apr. 20, 1993

[86] PCT No.: PCT/FR93/00387

§ 371 Date: Dec. 20, 1994

§ 102(e) Date: Dec. 20, 1994

[87] PCT Pub. No.: WO94/24686

PCT Pub. Date: Oct. 27, 1994

[51] Int. Cl.[6] ..... H01H 9/00

[52] U.S. Cl. ..... 200/50.01; 200/43.11; 200/308

[58] Field of Search ..... 200/5 R–5 F, 6 R, 200/6 B, 6 BA, 6 BB, 6 C, 17 R, 43.01–43.22, 293.1–307, 308–317, 339, 50 C, 50.01–50.4

[56] References Cited

U.S. PATENT DOCUMENTS

| | | | |
|---|---|---|---|
| 3,560,677 | 2/1971 | Kolb et al. | 200/50 C |
| 3,928,743 | 12/1975 | Ohashi | 200/308 |
| 4,389,549 | 6/1983 | Brown | 200/5 R |
| 4,635,013 | 1/1987 | Lemarquand et al. | 200/308 X |
| 4,975,548 | 12/1990 | Brouilette et al. | 200/5 R |
| 5,038,121 | 8/1991 | Fraulo et al. | 335/17 |
| 5,063,479 | 11/1991 | Satoh | 200/315 X |
| 5,329,080 | 7/1994 | Pierce et al. | 200/5 B |

FOREIGN PATENT DOCUMENTS

| | | | |
|---|---|---|---|
| 1558448 | 1/1969 | France | H01H 23/24 |
| 2448216 | 8/1980 | France | H01H 3/46 |
| 2110002 | 6/1983 | United Kingdom | H01H 21/30 |

*Primary Examiner*—J. R. Scott
*Attorney, Agent, or Firm*—William A. Drucker

[57] ABSTRACT

Circuit breaker with two ON and OFF control buttons. The ON (14) and OFF (13) buttons are pivotably mounted in the box of the circuit breaker and have, in front projection, a difference in height (h) between their lower ends (20*b*, 20*b*'). Their upper ends (20*a*, 20*a*') alternately reveal and hide visualization elements (32, 32') provided on the front side (17) of the box.

12 Claims, 2 Drawing Sheets

FIG. 6
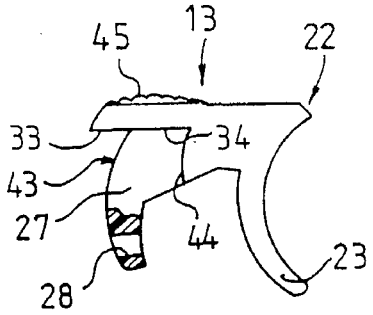
FIG. 7
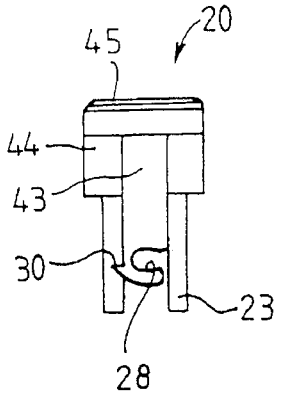
FIG. 10
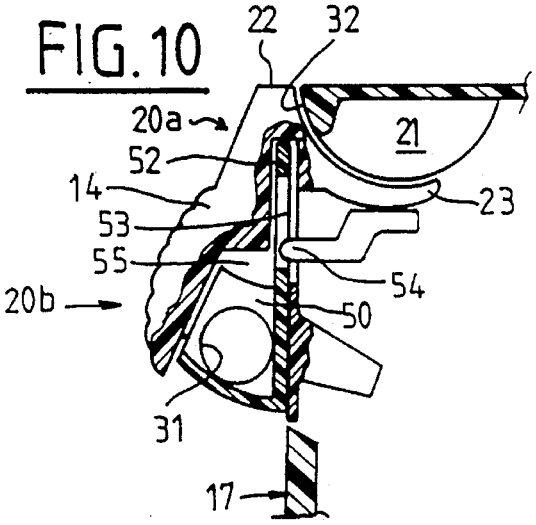
FIG. 8
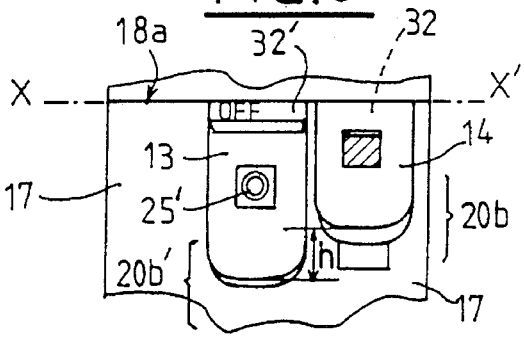
FIG. 11
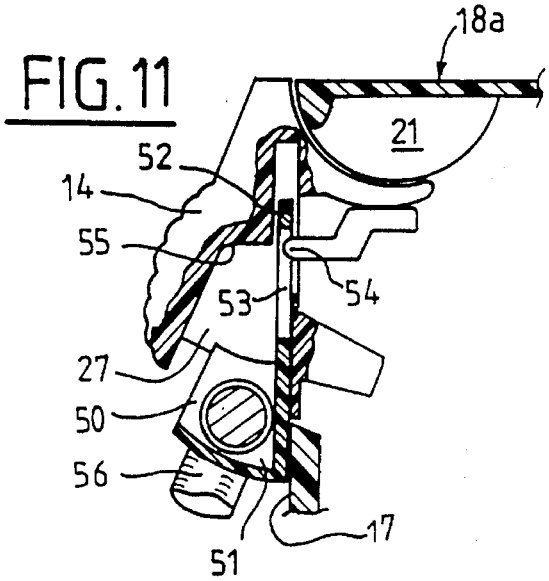
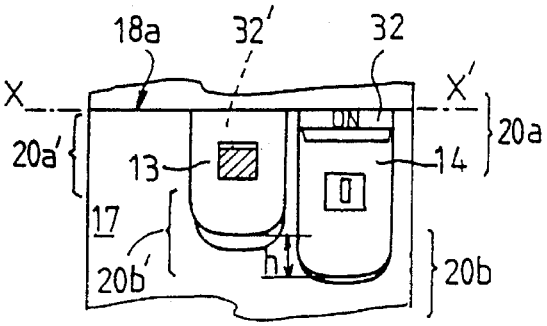
FIG. 9

CIRCUIT BREAKER WITH PIVOTING CONTROL BUTTONS

BACKGROUND OF THE INVENTION

This invention relates to a circuit breaker comprising a box containing a triggering and resetting mechanism susceptible of acting on separable contacts for opening and closing at least one electric current path. Openings are provided on the front side of the box for the passage of an "ON" control button and an "OFF" control button accessible to an operator.

Such a circuit breaker is described notably in French document No. 2,448,216. The control buttons are push buttons mounted in the box so as to slide in alternate manner between two operational positions, and having a front pressing side for the operator's finger. When the operator wants to close the contacts, he presses the ON push button which remains pressed in, whereas the OFF push button is automatically put into an outward position in relation to the box. Conversely, to open the contacts, the operator presses the OFF push button which remains pressed in, whereas the ON push button is automatically returned to the outward position. The alternating position of the push buttons thus gives the operator a clear idea of the status of the circuit breaker.

Though such a manual control device is satisfactory, it would be desirable, to provide a more ergonomic device having an accentuated visualization of its "ON" or "OFF" status.

French document No. 1,558,448 discloses the control of an electric switch by means of a pivoting button fitted with a transparent window; this window enables visualization of inscriptions representative of two operational positions of said switch. The control of a circuit breaker is also known by means of a pivoting control button called a "tumbler" with which a triggering visualization means is associated. However, the known pivoting control buttons do not fully provide the desirable working safety and clearness of visualization.

SUMMARY OF THE INVENTION

The main object of the invention is to combine, in a circuit breaker of the above-mentioned type, an ergonomic manual control separating the ON and OFF control functions in combination with good visualization of the ON operating status, and, preferably, of the ON and OFF operating statuses of the circuit breaker.

It is further an object of the invention to facilitate the locking of the manual control device in its OFF position.

According to the invention:

- the ON and OFF buttons of the circuit breaker are pivotably mounted in the box,
- the pressing side of each button is unique and delimited by a first low-displacement end near which is situated a pivot gudgeon and by a second high-displacement end,
- the mechanism is coupled to pivoting arms of the buttons for creating, at least in the ON position, a difference in height in front projection of the second end of the OFF button in relation to that of the ON button.

The control buttons, preferably placed side by side to pivot about a common axis substantially situated at the level of a side of the box perpendicular to its front side, thus not only providing a distinctive projection but also a difference in frontal height of their second end and therefore a satisfactory visual indication of status. This indication is preferably corroborated by the presence of indications carried by the box near the first end of the pressing side, preferably by the gudgeons of the buttons, to be alternately revealed and masked by the first end, and/or opposite transparent windows provided in the pressing sides.

At the second end and on the opposite side of the pressing side, it is interesting to provide a stop surface applicable against the front side of the box, and, an arm for operating the mechanism and having a lateral opening for the passage of a lock.

BRIEF DESCRIPTION OF THE DRAWINGS

A preferred embodiment of the invention is described hereinafter, by way of a non-limiting example, in reference to the appended drawings.

FIGS. 6 and 7 represent the OFF button of the circuit breaker laterally and from below.

FIGS. 8 and 9 show partial elevations of the front side of the box for the respective ON and OFF statuses of the circuit breaker.

FIGS. 10 and 11 show lateral elevations of another embodiment of the ON button in two distinctive operating statuses.

DESCRIPTION OF THE PREFERRED EMBODIMENT

Figure 1:
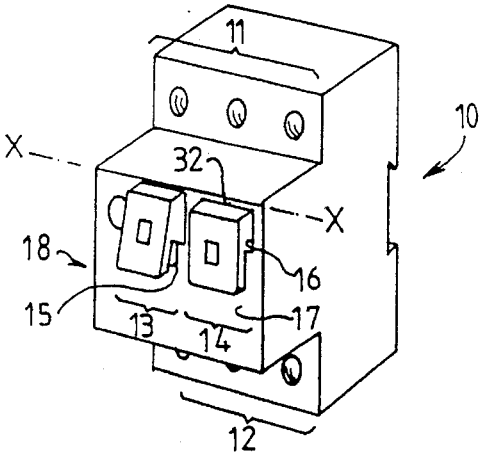
FIG. 1 represents in perspective a circuit breaker embodying the invention.

The electrical device illustrated in the figures is a circuit breaker called motor circuit breaker, comprising a box 10 which contains a triggering mechanism with lock and resetting, acting on mobile contacts separable from fixed contacts, for opening and closing several current paths connected between respective couples of terminals 11, 12.

The motor circuit breaker comprises, for manually acting on the mechanism, two buttons 13, 14 mounted side by side pivoting about a common axis X and running through two respective windows 15, 16 which are arranged in the front wall 17 of a nose 18 of the box 10. As a variation, the buttons could be mounted otherwise than side by side. Subsequent to a voluntary or automatic command, the buttons take on, in alternating and mutually inverse manner, an inward operational position and an outward operational position in relation to the wall 17. The buttons 13 and 14 cooperate with the mechanism through a control part 19 (see FIGS. 2 and 3) with which they are engaged and which pivots about an axis Y perpendicular to the plane containing the axis X.

Figure 2:
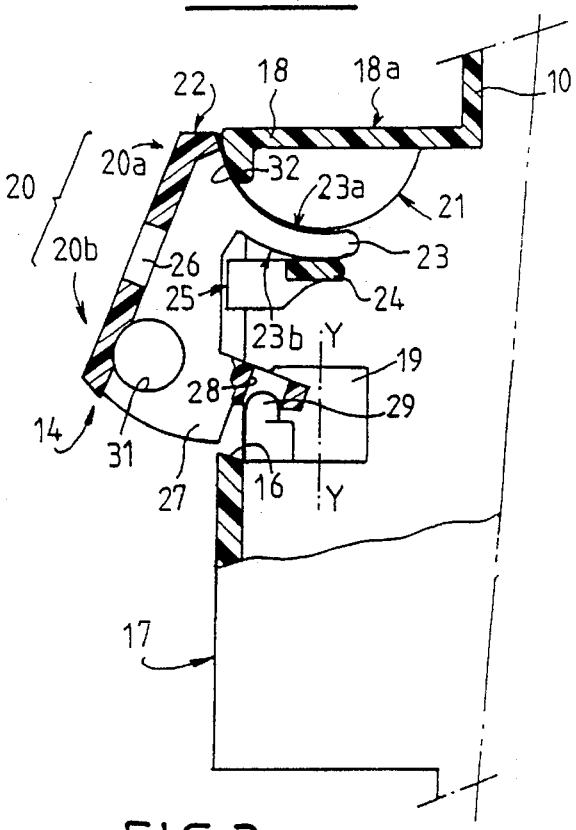
FIGS. 2 and 3 show an elevation of a front part of the box of the circuit breaker illustrating the pivoting ON button respectively in the outward and inward positions.
Figure 4:
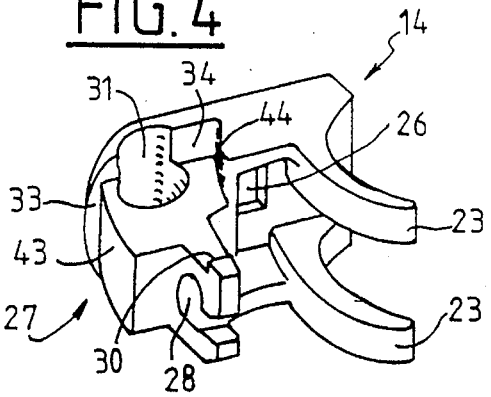
FIG. 4 is a perspective view from below the ON button.
Figure 3:
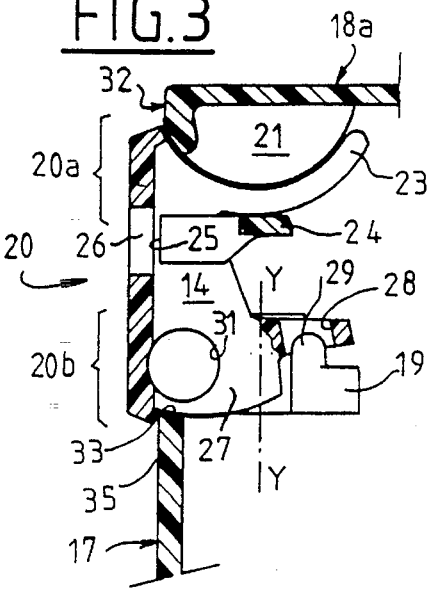

The pivoting ON button 14 will now be described with reference to FIGS. 2 to 4. It comprises a pressing side 20 for the operator's finger. This pressing side is flat, but can also be slightly concave or convex, and has two ends 20*a*, 20*b*; it is unique, i.e. the operator only activates the button by pressing this side and only in one direction.

The first end 20*a* of the pressing side 20 has a displacement of low amplitude determined by the proximity of the axis X of a gudgeon 21 on which the button pivots. The end 20*a* of the pressing side has a sloping edge 22 whose role will become apparent hereinafter.

Near the end 20*a*, but on the reverse side of the pressing side 20, i.e., inward the box, the button 14 has two curved pivoting arms 23 capable of sliding, by one side 23*a* on the gudgeon 21, and, by an opposite side 23*b* on a fixed bearing element 24. The bearing element is extended towards the front side 17 of the box by a visualizing means 25 susceptible of appearing opposite a window 26 of the button when the button is in its inward operational position. The window 26 is constituted by a patch in transparent material.

Near the end 20*b* and on a side opposite to the pressing side, the button has a control arm 27 cooperating with the control part 19 of the mechanism. For this purpose, the arm is fitted with a lodging 28 having a shape enabling it to engage onto a slug 29 of the part 19 and to cooperate with it to activate, or respectively be activated by, the part 19. A catch 30 provided near the free end of the control arm 27 enables the button 14 to be made elastically enter the opening 16, but avoids untimely exiting thereof by abutment against an edge of the window 16 or against another stop provided in the box. Finally, the control arm 27 comprises an opening 31 for the passage of a lock which maintains the button in the outward position.

The surface of the gudgeon 21 has, at its end located towards the front surface 17 of the box, a visualization area 32. This area 32 bears, for instance, the indication ON for the button 14 and the indication OFF for the button 13 (see FIGS. 1, 5 and 8, 9). The area is alternately revealed and hidden by the low-displacement end 20*a* of the pressing side 20. In each couple of operational positions of the two buttons, one of the visualization areas of the buttons is revealed, and the other is hidden. In FIG. 2, the end 20*a* of the pressing side can be seen to mask the area 32, the sloping edge 22 being aligned with the part adjacent to the horizontal side 18*a* of the nose 18 which is perpendicular to the vertical front side 17; in FIG. 3, the end 20*a*, aided by the shape of the sloping edge 22, can be seen to reveal the area 32.

Near the edges and on the opposite side of the pressing side 20, the button comprises stop surfaces 33, 34 which are applied, in order to limit the inward travel of the button, against an inner edge 35 or lateral edges 36 of the opening 16 in the front face 17.

Figure 5:
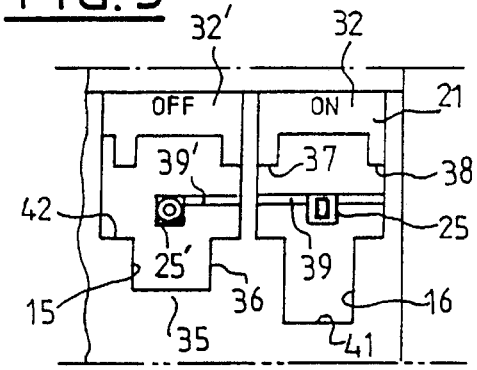
FIG. 5 is a partial front view of the front part of the box, with the buttons removed.

In FIGS. 5, 8 and 9, the references relating to the button 13 will be attributed a ' marking when necessary to distinguish an element of button 13 from an equivalent element of button 14.

As can be sen in FIG. 5, that each gudgeon 21 can be broken down into two rests 37, 38 each cooperating with one of the pivoting arms 23; and each visualizing means 25, 25', e.g. "0" for the OFF button 13 and "1" for the ON button 14, is borne by a horizontal arm 39, 39' of the bearing element which determines a sliding surface for at least one of the arms 23.

The opening 16 provided for the ON button 14 is slightly taller than the opening 15 associated with the OFF button 13, since the corresponding control arm 27, which comprises the orifice 31, is taller. Intermediate horizontal edges 42 are added to the lower edges 41 of the openings to guide respective cylindrical surfaces 43, 44 of the buttons.

The pivoting OFF button 13 is illustrated in FIGS. 6 and 7. It will not be described in any further detail as it is similar to button 14, except for the control arm 27 which is shorter as it does not need to comprise the orifice 31. Striae 45 or other non-slip contrivances can be provided on the lower part of the pressing side 20 of the two buttons.

The pivoting buttons are mounted in the box in the following manner. The free end of the pivoting arms 23 is inserted between the gudgeon 21 and the bearing element 24, then the catch 30 goes past the hard point associated with it and the control arm 27 engages by way of its lodging 28 onto the slug 29 of the control part 19. To close the contacts of the circuit breaker, the operator presses the ON button 14 and the mechanism puts the OFF button 13 into the outward position, only the ON area 32 and the "1" visualizing means 25 of the button 14 are then visible (FIG. 9). To open the contacts, the operator presses the OFF button 13 to put it into the inward position; only the OFF area 32' and the "0" means 25' of the button 13 are then visible (FIG. 8). As can be seen in FIGS. 8 and 9, the end 20*b* of the ON button 14 is in the ON status and in the OFF status of the circuit breaker at a level differentiated with regard to the end 20*b'* of the OFF button 13, this being translated both by a differentiated projection from side 17 and by a difference in height h of the front projections of the lower edges of the buttons, whether the OFF button is activated in the maintained mode or by pulses.

In the variation in FIGS. 10 and 11, the orifice 31 for the passage of the lock is provided in a pull 50, more precisely in a broad part 51 of this pull, which is lodged in the ON button 14 in such a way as to take on an unobtrusive position (FIG. 10) and an outward locking position (FIG. 11). The broad part 51 of the pull is situated in the vicinity of the high-displacement end 20*b* of the button. The pull further comprises a tail 52 fitted with an opening 53 of which the upper edge cooperates with an abutment 54 of the box for stopping the pull in the outward position. The pull cooperates with its housing 55 in the button 14 by means of appropriate guide surfaces and stop surfaces; it stays maintained in the unobtrusive position by catching or retaining means and rests, in the outward position, against the front side 17 of the box. When the lock 56 is installed in the orifice 31, it prohibits the pull from returning to the unobtrusive position by abutment against the arm 27.

The invention can be applied to any circuit breaker or directional relay in which one wishes to conciliate the security of manual activation and the quality of status visualization.

I claim:

1. A circuit breaker comprising a box containing a triggering and resetting mechanism acting on separable contacts for opening and closing at least one electric current path, the box comprising a front wall fitted with passage openings for an ON button and an OFF button, said ON button and OFF button being accessible to an operator from outside of the box and cooperating with a control piece of said mechanism inside the box, each button being mounted in the box so as to be movable between an outward operational position and an inward operational position with respect to the box and having a single pressing side for the operator's finger, each of said buttons being pivotably mounted in said box about a rotating axis by means of two curved arms which extend opposite from a low-displacement end portion of the pressing side, each of said curved arms comprising two opposite faces respectively sliding on a pivot gudgeon coaxial to said rotating axis and on a fixed bearing element, each of said buttons comprising a control arm which extends opposite a high-displacement end portion of the pressing side and which is couple to said mechanism, the curved arms and the gudgeon being arranged so as to create between said inward and outward operational positions, a significant shift in front projection of said high-displacement end portion.

2. The circuit breaker as claimed in claim 1, wherein the front wall of the box comprises a first visualizing means which is revealed and respectively hidden by said low-displacement end portion of the pressing side of each of said buttons in both the inward and outward operational positions.

3. The circuit breaker as claimed in claim 2, wherein the first visualizing means (32) is borne by an end of the surface of the gudgeon.

4. The circuit breaker as claimed in claim 2, wherein the low-displacement end portion of the pressing side of each of said buttons has a sloping edge.

5. The circuit breaker as claimed in claim 1, wherein each of said buttons has, on at least one edge and on the reverse side of the pressing side, a stop surface that can be applied against the front wall of the box.

6. The circuit breaker as claimed in claim 1, wherein said rotating axis is substantially located along a side of the box which is perpendicular to its front wall.

7. The circuit breaker as claimed in claim 1, each of said buttons has a shape which is such that it can be freely inserted from the front wall of the box into one respective of said passage openings in the box, each of said buttons having a retaining catch to prevent it from being extracted unexpectedly.

8. The circuit breaker as claimed in claim 1, wherein the ON button has, near the high-displacement end portion of the pressing side, an orifice of an axis parallel to said rotating axis wherein a lock is engaged for locking the ON button in said outward operational position.

9. The circuit breaker as claimed in claim 8, wherein the orifice for the lock to pass is located in a broad part of a pull which is housed mobile in the ON button so as to take on an unobtrusive position and an outward locking position and which, in said outward position, can be applied against the front wall of the box.

10. The circuit breaker as claimed in claim 1, wherein each of said buttons comprises a visualization window and the box comprises second visualizing means which are visible through the respective window of each of said buttons only when the button is in the inward operational position.

11. The circuit breaker as claimed in claim 10, wherein said second visualizing means are borne by said fixed bearing element.

12. A circuit breaker comprising a box containing a triggering and resetting mechanism acting on separable contacts for opening and closing at least one current path, the box comprising a front wall fitted with passage openings for an ON button and an OFF button, said buttons being accessible to an operator from outside of the box and cooperating with a control piece of said mechanism inside the box, each buttons being mounted in the box so as to be mobile between two operational positions and having a single pressing side for the operator's finger, the ON and OFF buttons of the circuit breaker being pivotably mounted about a pivot gudgeon in the box, the pressing side of each button being delimited by a low-displacement end located near said pivot gudgeon and by a high-displacement end, the curved arms and the gudgeon being arranged to enable said low-displacement end to reveal and respectively hide a first visualizing means located on the front wall of the box in both the operational positions of each button.

* * * * *